US006396527B1

(12) United States Patent
Yamaguchi

(10) Patent No.: US 6,396,527 B1
(45) Date of Patent: May 28, 2002

(54) HEAT-SENSITIVE RECORDING APPARATUS

(75) Inventor: Akira Yamaguchi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/933,001

(22) Filed: Aug. 21, 2001

(30) Foreign Application Priority Data

Aug. 21, 2000 (JP) ..... 2000-249212

(51) Int. Cl.[7] ..... B41J 2/35; B41J 2/52
(52) U.S. Cl. ..... 347/183; 347/211
(58) Field of Search ..... 347/183, 211; 400/120.07

(56) References Cited

U.S. PATENT DOCUMENTS 4,933,686 A * 6/1990 Izumi et al. ..... 347/183
5,438,352 A * 8/1995 Agano ..... 347/183

* cited by examiner

*Primary Examiner*—Huan Tran
(74) *Attorney, Agent, or Firm*—Sughrue Mion, PLLC

(57) ABSTRACT

The heat-sensitive recording apparatus having a thermal head with heating elements arranged in one direction, a transport unit by which the thermal head and a heat-sensitive recording material being pressed by it are transported relative to each other in a direction normal to the one direction in which the heating elements are arranged and a drive unit that disperses image data for one pixel into a specified number of pieces and which drives the heating elements in the thermal head in accordance with the dispersed image data to perform heat-sensitive recording. The heat-sensitive recording by means of the drive unit satisfies $T/n \leqq 50\ \mu sec$, where T is a period of recording the one pixel and n is the specified number of pieces into which the image data for one pixel is dispersed. The apparatus produces small enough recording sound to permit quiet heat-sensitive recording with the thermal head.

5 Claims, 4 Drawing Sheets

HEAT-SENSITIVE RECORDING APPARATUS

BACKGROUND OF THE INVENTION

This invention relates to the technology of heat-sensitive recording using the thermal head. The invention particularly relates to a heat-sensitive recording apparatus capable of quiet recording.

Heat-sensitive recording is used as a means of recording with various types of printer, plotter, facsimile, recorder, etc. Heat-sensitive recording has various advantages such as no need for wet development and ease of handling, so its application to image recording for medical diagnoses that require large and high-quality image as in CT, MRI and X-ray imaging is currently being studied.

As is well known, heat-sensitive recording uses a thermal head having heating elements arranged in one direction (the main scanning direction); with the thermal head being slightly pressed onto the heat-sensitive material, the two members are moved relative to each other in the auxiliary scanning direction which is normal to the main scanning direction and in accordance with the image to be recorded, the heating element for each pixel is supplied with energy to generate heat so that the recording layer of the heat-sensitive material is hated to record image.

The heating elements (heat generating resistors) are usually arranged as tiny projection or elevation called "glaze" that extend in the main scanning direction.

In heat-sensitive recording with the thermal head, a transport roller called "platen roller" is commonly used to hold the heat-sensitive recording material under given pressure between itself and the thermal head; as the platen roller rotates, the thermal head is urged with the heat-sensitive material being held in a predetermined recording position and, at the same time, the heat-sensitive material is moved relatively in the auxiliary scanning direction to perform thermal recording.

During such thermal recording, the surface of the heat-sensitive material is melted upon heating and gets "stuck" to the thermal head upon cooling. As already mentioned, during thermal recording, the thermal head and the heat-sensitive recording medium are transported relative to each other in the auxiliary scanning direction as they are pressed together. Therefore, during thermal recording, the heat-sensitive material repeatedly gets stuck to and separates from the thermal head and "recording" sound is produced as these phenomena occur.

Needless to say, printers should produce smaller "recording" sound. In case of medical heat-sensitive recording apparatus which is often used in hospitals, the recording sound should be as small as possible in order to cause no greater stress to patients and doctors while ensuring that treatments can be done undisturbed. In medical applications, it is required to output hard copies having as high image quality and definition as X-ray films. To meet this requirement, the medical heat-sensitive recording apparatus uses a heat-sensitive material in the form of a double weight (heavy-gage) film and the thermal head is also urged at higher pressure during thermal recording. Since this requires a higher torque to transport the heat-sensitive material, the medical heat-sensitive recording apparatus which should be quieter than non-medical types will nevertheless produce greater "recording" sound.

SUMMARY OF THE INVENTION

The present invention has been accomplished under these circumstances and has as an object providing a heat-sensitive recording apparatus that produces small enough "recording" sound to permit quiet heat-sensitive recording with a thermal head even if the heat-sensitive material is transported under high torque during recording as is often the case in medical applications.

In order to attain the object described above, the present invention provides a heat-sensitive recording apparatus comprising: a thermal head with heating elements arranged in one direction; a transport unit by which the thermal head and a heat-sensitive recording material being pressed by it are transported relative to each other in a direction normal to the one direction in which the heating elements are arranged; and a drive unit that disperses image data for one pixel into a-specified number of pieces and which drives the heating elements in the thermal head in accordance with the dispersed image data to perform heat-sensitive recording; wherein the heat-sensitive recording by means of the drive unit satisfies $T/n \leqq 50\ \mu sec$, where T is a period of recording the one pixel and n is the specified number of pieces into which the image data for one pixel is dispersed.

Preferably, the heat-sensitive recording in accordance with the dispersed image data is multi-gradation heat-sensitive recording by pulse width modulation.

Preferably, the image data for one pixel is dispersed in such a way that respective pieces of dispersed image data are allocated in a generally uniform manner.

Preferably, successive cycles of dispersed recording of the one pixel are interrupted by a period during which no heating element is driven.

Preferably, dispersed recording of the one pixel is such that cycles of heat-sensitive recording with the dispersed image data are started at specified intervals.

DETAILED DESCRIPTION OF THE INVENTION

The heat-sensitive recording apparatus of the invention is described below in detail with reference to the preferred embodiments shown in the accompanying drawings.

Figure 1:
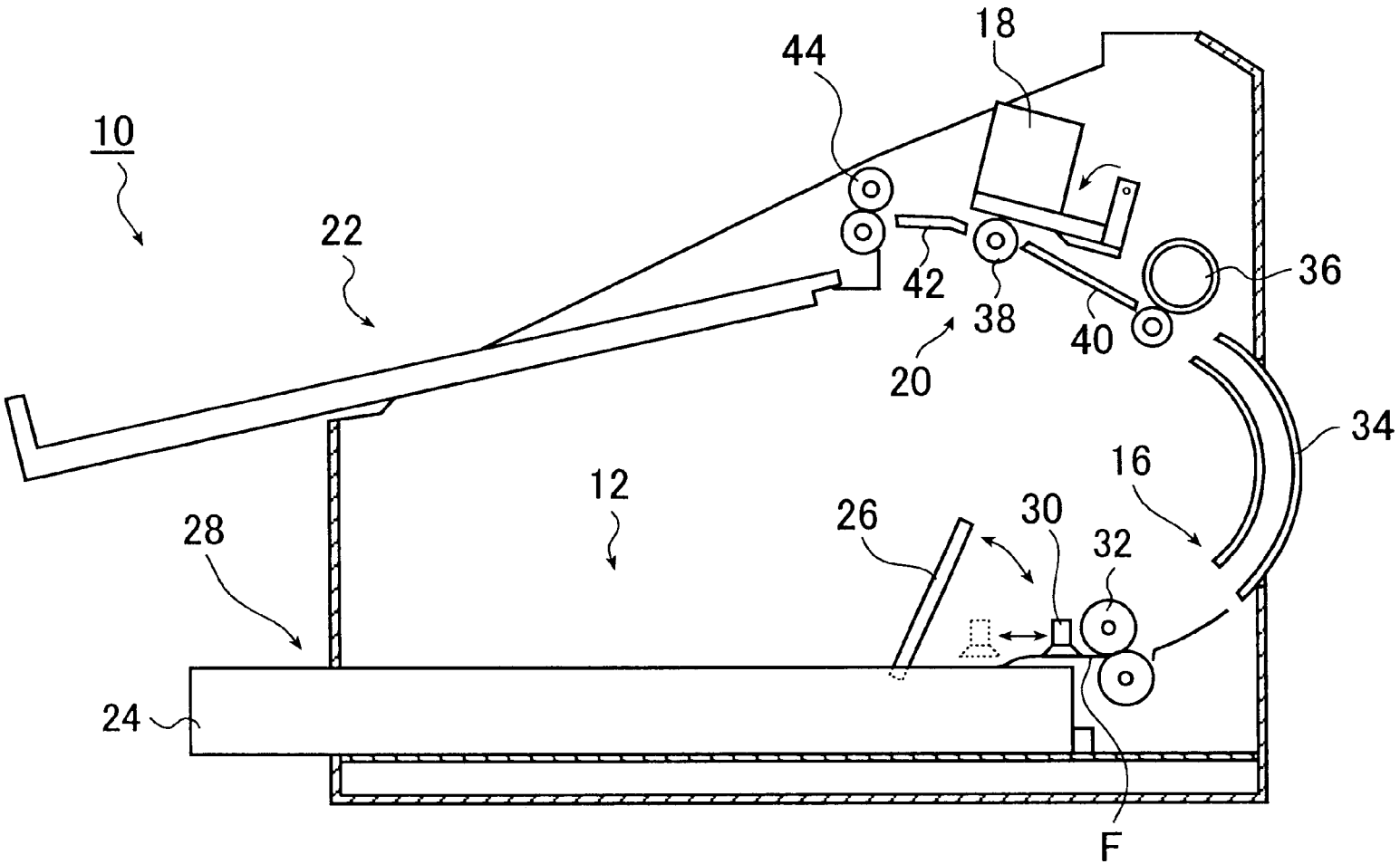
FIG. 1 shows in conceptual form an embodiment of the heat-sensitive recording apparatus of the invention.

FIG. 1 is a sectional view showing in conceptual form an embodiment of the heat-sensitive recording apparatus of the invention.

The heat-sensitive recording apparatus generally indicated at 10 is intended to perform thermal image recording on heat-sensitive materials such as a heat-sensitive film F (hereunder referred to as film F) of a specified size such as 14×17" size. The heat-sensitive recording apparatus 10 consists essentially of a loading section 12, a feed/transport section 16, a recording section 20 that uses a thermal head 18 to perform heat-sensitive recording on film F, and an ejection tray 22. The heat-sensitive recording apparatus 10 is essentially of a known type that uses a thermal head, except that it performs "dispersed recording" with the image data for one pixel being dispersed into a plurality of pieces and that it performs heat-sensitive recording so as to satisfy the relation $T/n \leqq 50\ \mu sec$, where T is the period of recording one pixel (one line in the auxiliary scanning direction) and n is the number of pieces into which the image data for one pixel is dispersed.

Film F typically uses a transparent poly ethylene terephthalate (PET) base and has a heat-sensitive recording layer formed on one side. A specified number of films F, say about 100 films, are stacked in a dedicated magazine 24. The magazine 24 having a cover 26 is slid inside the apparatus 10 through a slot 28 and positioned in the loading section 12 by known device such as the use of guides and stoppers.

The feed/transport section 16 picks up one of the films F from the magazine 24 in the loading section 12 and transports it to the recording section 20. The feed/transport section 16 has basically a sheet feeding mechanism using suckers 30 that suck the film F to be held in position, a transport roller pair 32, transport guides 34, a cleaning roller pair 36, and a mechanism (not shown) for opening and closing the cover 26.

When the heat-sensitive recording apparatus 10 receives a command to start recording, the opening/closing mechanism (not shown) opens the cover 26 of the magazine 24, from which one film F is picked up by the suckers 30 and fed into the transport roller pair 32. The film F is then moved between the transport guides 34 and fed into the cleaning roller pair 36, the upper member of which removes any dirt and dust from the recording surface of the film F before it is transported into the recording section 20. When all the films F that are to be subjected to recording have been ejected from the magazine 24, the aforementioned opening/closing mechanism will close the cover 26.

The recording section 20 has basically a thermal head 18, a platen roller 38, transport guides 40 and 42, an ejection roller pair 44, a drive unit 46 for the platen roller 38, and a fan (not shown) that is used to cool the thermal head 18.

The thermal head 18 is intended to perform heat-sensitive recording at a (pixel) density of, say, 300 dpi and it comprises a body having a glaze and a heat sink fixed to the body; the glaze has a plurality of heating elements arranged in one direction (the main scanning direction which is normal to the paper on which FIG. 1 is drawn).

As the platen roller 38 rotates while urging against the thermal head 18 (the glaze) via the film F, the film F is kept in a specified recording position, the thermal head is urged at a specified pressure, and the film F as held between the thermal head 18 and the platen roller 38 is transported in the auxiliary scanning direction (indicated by arrow b) which is normal to the main scanning direction.

The film F emerging from the cleaning roller pair 36 is moved past the transport guide 40 and transported as it is held between the platen roller 38 and the thermal head 18.

In parallel with this film transport, the thermal head 18 drives each of the heating elements by pulse width modulation in accordance with the image data (image to be recorded), whereby the associated heat-generating resistor is heated and the film F accordingly develops color by thermal development to record image.

The image carrying film F is moved past the transport guide 42 to be fed into the ejection roller pair 44, from which it is ejected into the ejection tray 22 as an image-carrying hard copy.

Figure 2:
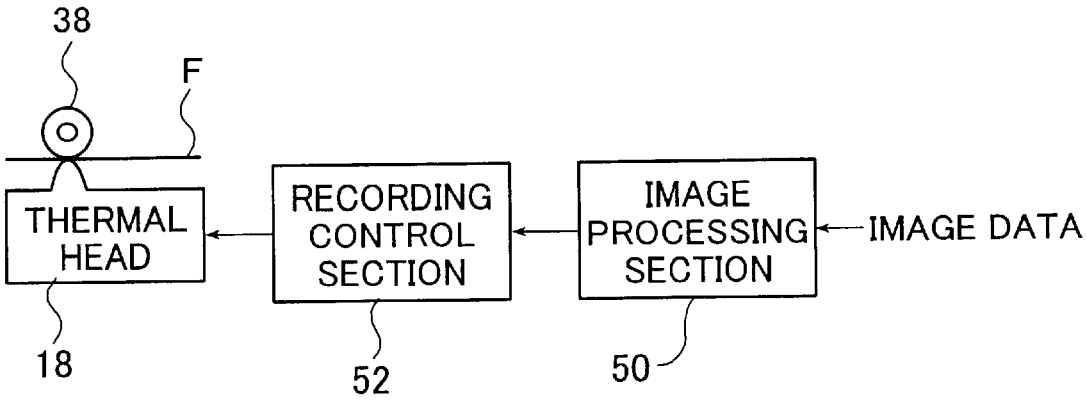
FIG. 2 is a block diagram of an exemplary recording control system that can be used with the heat-sensitive recording apparatus shown in FIG. 1.

In one example, this process of heat-sensitive recording with the thermal head 18 is controlled by a recording control system comprising an image processing section 50 and a recording control section 52, as shown in FIG. 2.

Image data, typically of 10 bits (0–1023), that is supplied from an image data supply source such as CT or MRI is first sent to the image processing section 50, where it is subjected to various image processing schemes such as K (black) ratio correction, shading correction, sharpness correction, gradation correction, temperature correction and resistance correction. Thereafter, the image data is sent to the recording control section 52. The image processing schemes mentioned above may be performed by known methods.

In the recording control section 52, the supplied image data is expanded into a specified number of pieces of dispersed image data (which are hereunder referred to as "dispersed data") and each piece of the dispersed data is further expanded into binary data which take on either the value "zero" (not heat generated) or "one" (heat generated). For example, the supplied 10-bit image data is expanded into 256 pieces of dispersed data in 8 gradations as will be described later on and each piece of the dispersed data is further expanded into 8 pieces of binary data which are then supplied into the thermal head 18. Thus, each piece of the binary data corresponds to one gradation of the dispersed data (image data).

In response to the binary data (which is hereunder referred to as "heat generation data"), the drive ICs for the thermal head 18 drive the individual heating elements to perform heat-sensitive recording by pulse width modulation.

In the heat-sensitive recording apparatus 10 of the invention, dispersed recording is done in such a way as to satisfy the relation $T/n \leqq 50\ \mu sec$, where T is the line period (in seconds) or the recording time period corresponding to the recording of one pixel, and n is the number of pieces into which the image data for one pixel is dispersed.

As already mentioned, in ordinary heat-sensitive recording, the thermal head and the film F (heat-sensitive material) are moved relative to each other in the auxiliary scanning direction as the individual heating elements in the thermal head are driven (to generate heat) in accordance with the image data, whereby the film F develops color to record an image. The start position for the recording of each image data, or one pixel, in the auxiliary scanning direction is predetermined in accordance with the recording line period and all heating elements start to generate heat at the same time and stop generating the heat in accordance with the specific image data. As a result, the density of the recorded image becomes high in the upstream area but low in the downstream area, producing a visible degree of unevenness in the low density area extending in the main scanning direction.

It is known that this problem can be prevented by performing dispersed heat-sensitive recording. In dispersed recording, a single image data is divided into a specified number of pieces which are recorded as dispersed in the auxiliary scanning direction. Take, for example, 10-bit image data; it is expanded into eight pieces of 8-bit dispersed data and 8-bit heat-sensitive recording is performed eight times in one pixel, thereby representing a 10-bit image (gradation). As a result, the coloring region of one pixel is dispersed over the entire region to produce a record of high-quality image that is free from the aforementioned unevenness in low-density area.

As already mentioned, "recording" sounds are generated during heat-sensitive recording because the film F (heat-sensitive material) repeatedly gets stuck to and separates from the thermal head 18. Particularly large "recording" sounds are produced from medical heat-sensitive recording apparatus which are designed to transport the film F with increased torque.

To solve this problem, the heat-sensitive recording apparatus of the invention not only performs dispersed recording but also satisfies the relation T/n≦50 μsec so that the time of recording with one piece of dispersed data (which time is hereunder referred to as "dispersed period") is no longer than 50 μsec (at least 200 kHz in terms of frequency). If this condition is met, the period of generation of the "recording" sound, or the period at which the film F repeatedly gets stuck to and separates from the thermal head 18, is rendered to be outside the audible range of the average human ear so that quiet heat-sensitive recording can be realized even if the film F is transported with high torque. An example of the dispersed heat-sensitive recording that is performed by the apparatus of the invention is described below.

Figure 3:
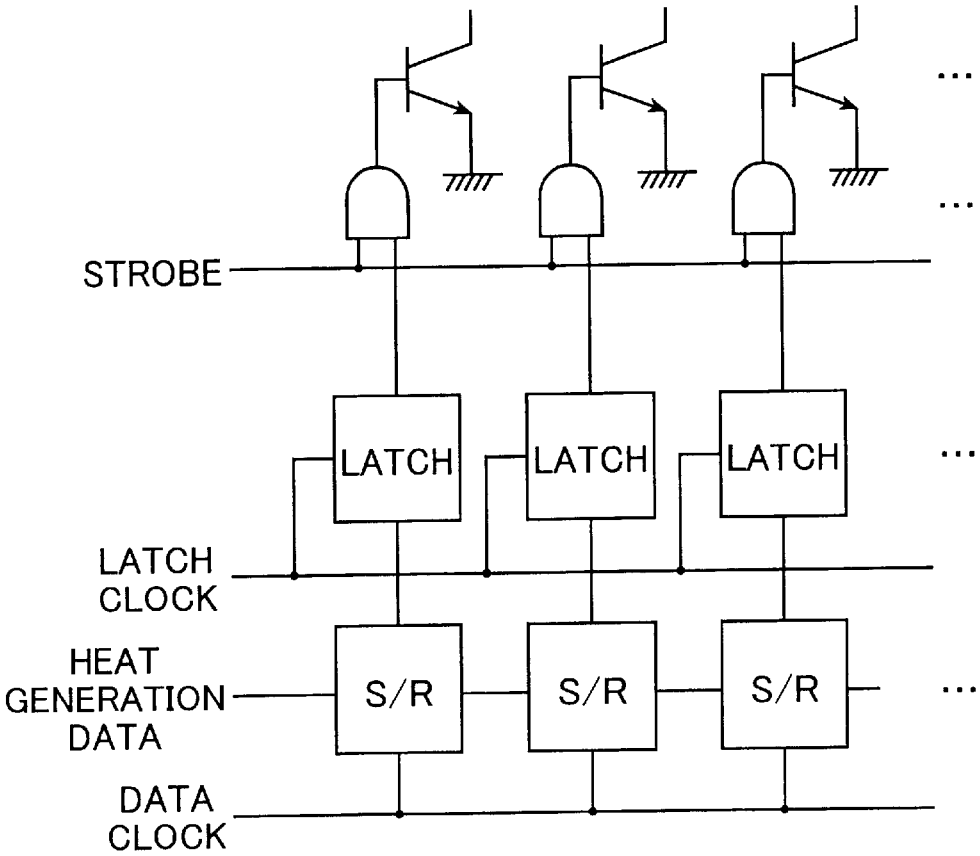
FIG. 3 shows in conceptual form exemplary drive ICs for the thermal head.

FIG. 3 shows exemplary drive ICs for the heating elements in the thermal head 18. As already mentioned, the heat generation data the illustrated drive ICs receive from the recording control section 52 is binary data which takes on either zero "0" or one "1" and corresponds to one gradation of the dispersed data. The heat generation data are successively sent by shift registers (S/R) in response to data clocks. The heat generation data are then held in latches in response to latch clocks. If data "1" is held in a latch and if the strobe to be input to an AND circuit is ON, the associated heating element turns on to generate heat.

In the illustrated drive ICs for the thermal head 18, shift registers corresponding to 64 heating elements are cascaded. The data clocks have a frequency of 16 MHz (=62.5 nsec/clock). Therefore, the time required to transfer the heat generation data for the 64 heating elements is 4 μsec (=62.5 nsec×64). In other words, a transfer time of 4 μsec is required per gradation in dispersed recording (per heat generation data).

Speaking of the thermal head 18, it can record on films of 14×17" size at a density of about 300 dpi and has 4096 heating elements. As already mentioned, shift registers corresponding to 64 heating elements are cascaded in the drive ICs for the thermal head 18. Hence, a total of 64 driver ICs (4096/64=64) are mounted on the thermal head 18 and image data are input over 64 lines.

Figure 4:
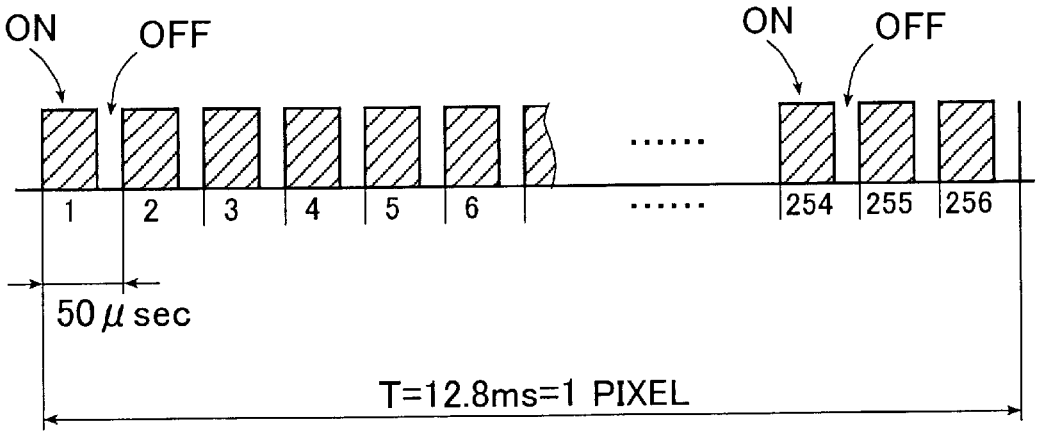
FIG. 4 is a diagram for illustrating an example of the dispersed recording which is done by the heat-sensitive recording apparatus of the invention.

Turning back to the heat-sensitive recording apparatus 10, the line period T is 12.8 msec. Therefore, in order to satisfy the relation T/n≦50 μsec in dispersed recording (the dispersed period should not be greater than 50 μsec), the value of n should be at least 256. Preferably, n is set to such a value that multi-gradation heat-sensitive recording can be performed with the dispersed data by pulse width modulation. Suppose here that 10-bit image data is supplied to the recording control section 52. This image data is preferably expanded into 256 pieces of dispersed data in 8 gradations ranging from 1 to 8 (or 9 gradations including 0) as shown in FIG. 4 (T/n=) 50 μsec). In other words, dispersed heat-sensitive recording with the dispersed data of 8 gradations is performed 256 times to represent a 10-bit pixel.

It should be noted here that even if the relation T/n≦50 μsec is satisfied, continuous performing of dispersed recording can potentially produce "recording sound" due to the generation of low-frequency components. To avoid this possibility, successive cycles of dispersed recording are preferably interrupted by a non-record or record-off time during which no heating element is driven (see FIG. 4).

In order to prevent the generation of low-frequency components, heat generation in each cycle of dispersed recording is preferably started at a specified period as shown in FIG. 4 (in which the period is set at 50 μsec).

In order that the above-described heat-sensitive recording is performed with fast enough data transfer and with a record-off time being set between successive cycles of dispersed recording, the time of heat generation per gradation (by one heat generation data) is preferably set to be longer than the data transfer time for 64 heating elements but shorter than the dispersed period (T/n) divided by the number of gradations in the dispersed data. In the case under consideration, this condition can be described as 4 μsec<the time of heat generation per gradation<6.25 μsec.

Figure 5:
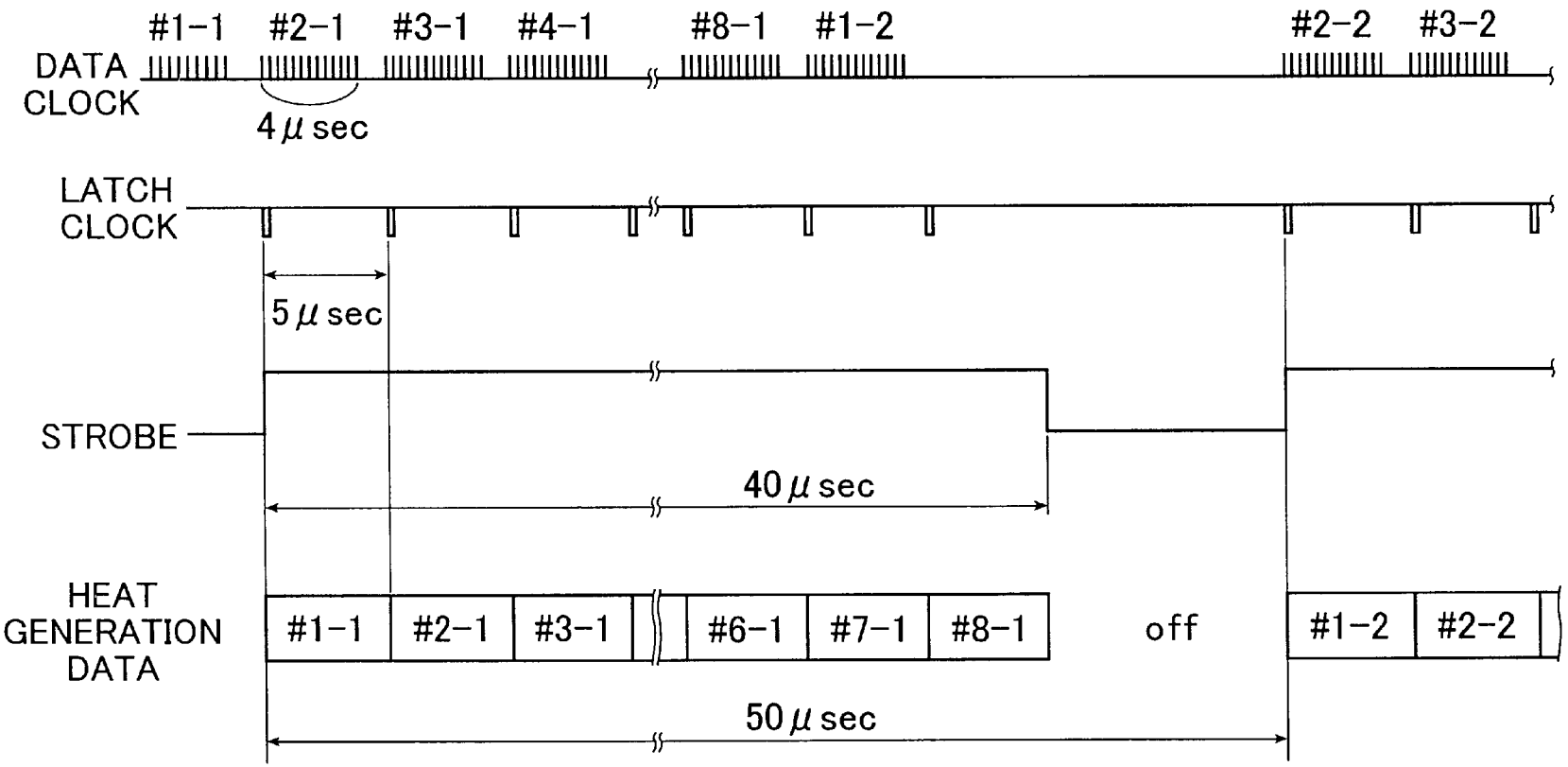
FIG. 5 shows pulse sequences for the dispersed recording which is done by the heat-sensitive recording apparatus of the invention.

FIG. 5 shows exemplary pulse sequences for the case where the time of heat generation per gradation is set at 5 μsec to satisfy the above-mentioned condition. In FIG. 5, #2-1 represents the second piece of heat generation data in the first piece of dispersed data and #2-2 represents the second piece of heat generation data in the second piece of dispersed data.

As already mentioned, the data clocks to be applied in the case under consideration have a frequency of 16 MHz, so a transfer time of 4 μsec is necessary per gradation. Since the time of heat generation per gradation is 5 μsec, each of the latch clocks for holding the heat generation data in the latches is ON once every 5 μsec. Since dispersed recording is done in 8 gradations and the dispersed period (T/n) is 50 μsec, the period at which the strobes repeat themselves comprises an on-time of 40 μsec (=5 μsec×8 gradations) and an off-time of 10 μsec. Thus, a record-off time of 10 μsec is set between successive cycles of dispersed recording.

In the case under consideration, a maximum duty in heat generation is 80% (40 μsec/50 μsec×100) and the drive voltage on the thermal head is so set that the required maximum density can be produced at 80% duty.

The method of expanding the image data in the present invention is in no way limited. However, if dispersion is not uniform, unwanted low-frequency components are generated and recording sounds in the audible range are likely to occur. To avoid this possibility, the image data is preferably expanded into pieces of dispersed data that are allocated in a generally uniform manner.

The following Table 1 shows this preferred case of expanding 10-bit image data into 256 pieces of dispersed data in 8 gradations (1–8, or 9 gradations including 0).

TABLE 1

| Image | Dispersed data | | | | | | |
|---|---|---|---|---|---|---|---|
| data | #1 | #2 | #3 | | #254 | #255 | #256 |
| 0 | 0 | 0 | 0 | . . . | 0 | 0 | 0 |
| 1 | 1 | 0 | 0 | . . . | 0 | 0 | 0 |
| 2 | 1 | 1 | 0 | . . . | 0 | 0 | 0 |
| . | . | . | . | . | . | . | . |
| . | . | . | . | . | . | . | . |
| . | . | . | . | . | . | . | . |
| 255 | 1 | 1 | 1 | . . . | 1 | 1 | 0 |
| 256 | 1 | 1 | 1 | . . . | 1 | 1 | 1 |
| 257 | 2 | 1 | 1 | . . . | 1 | 1 | 1 |
| . | . | . | . | . . . | . | . | . |
| . | . | . | . | . . . | . | . | . |
| . | . | . | . | . . . | . | . | . |
| 2046 | 8 | 8 | 8 | . . . | 8 | 7 | 7 |
| 2047 | 8 | 8 | 8 | . . . | 8 | 8 | 7 |

There is also no limitation on the method of expanding the dispersed data into heat generation data, provided that in order to start heat generation on the same timing in each cycle of dispersed recording and to ensure continuous heat generation within one cycle of dispersed recording, it is preferred that data "1" (heat generated) is first input to the thermal head 18, followed by successive inputting of "1".

The following Table 2 shows this preferred case of expanding dispersed data in 8 gradations into eight binary heat generation data taking on either zeros or ones.

TABLE 2

| Dispersed | Heat generation data | | | | | | |
|---|---|---|---|---|---|---|---|
| data | #1 | #2 | #3 | | #6 | #7 | #8 |
| 0 | 0 | 0 | 0 | . . . | 0 | 0 | 0 |
| 1 | 1 | 0 | 0 | . . . | 0 | 0 | 0 |
| 2 | 1 | 1 | 0 | . . . | 0 | 0 | 0 |
| . | . | . | . | . | . | . | . |
| . | . | . | . | . | . | . | . |
| . | . | . | . | . | . | . | . |
| 7 | 1 | 1 | 1 | . . . | 1 | 1 | 0 |
| 8 | 1 | 1 | 1 | . . . | 1 | 1 | 1 |

While the heat-sensitive recording apparatus of the invention has been described above in detail, it should be noted that the invention is by no means limited to the foregoing embodiments and various improvements and modifications can of course be made without departing from the scope and spirit of the invention.

As described on the foregoing pages in detail, the heat-sensitive recording apparatus of the invention has the advantage that even if it has to transport the heat-sensitive material with an increased torque as in medical heat-sensitive recording apparatus, the "recording" sounds can be rendered to occur outside the audible range of the average human ear so as to perform quiet heat-sensitive recording.

What is claimed is:

1. A heat-sensitive recording apparatus comprising:

a thermal head with heating elements arranged in one direction;

a transport unit by which said thermal head and a heat-sensitive recording material being pressed by it are transported relative to each other in a direction normal to said one direction in which said heating elements are arranged; and a drive unit that disperses image data for one pixel into a specified number of pieces and which drives the heating elements in said thermal head in accordance with the dispersed image data to perform heat-sensitive recording;

wherein said heat-sensitive recording by means of said drive unit satisfies $T/n \leqq 50\ \mu sec$, where T is a period of recording said one pixel and n is the specified number of pieces into which said image data for one pixel is dispersed.

2. The heat-sensitive recording apparatus according to claim 1, wherein said heat-sensitive recording in accordance with said dispersed image data is multi-gradation heat-sensitive recording by pulse width modulation.

3. The heat-sensitive recording apparatus according to claim 1, wherein said image data for one pixel is dispersed in such a way that respective pieces of dispersed image data are allocated in a generally uniform manner.

4. The heat-sensitive recording apparatus according to claim 1, wherein successive cycles of dispersed recording of said one pixel are interrupted by a period during which no heating element is driven.

5. The heat-sensitive recording apparatus according to claim 1, wherein dispersed recording of said one pixel is such that cycles of heat-sensitive recording with said dispersed image data are started at specified intervals.

* * * * *